United States Patent [19]

Diaz et al.

[11] Patent Number: 5,005,300

[45] Date of Patent: Apr. 9, 1991

[54] TUBULAR CUSHIONING SYSTEM FOR SHOES

[75] Inventors: Juan A. Diaz, Weymouth; Mark R. Goldston, Newton; Spencer White, Marion; David E. Miller, Carver; Charles P. Legassie, Canton, all of Mass.; Wayne Russell, Wakefield, England; Judith C. Ringel, Milton, Mass.

[73] Assignee: Reebok International Ltd., Stoughton, Mass.

[21] Appl. No.: 492,434

[22] Filed: Mar. 7, 1990

Related U.S. Application Data

[63] Continuation of Ser. No. 304,615, Feb. 1, 1989, abandoned, which is a continuation-in-part of Ser. No. 70,214, Jul. 6, 1987, abandoned.

[51] Int. Cl.[5] ..... A43B 13/20; A43B 13/18; A43B 5/00

[52] U.S. Cl. ..... 36/114; 36/28; 36/31

[58] Field of Search ..... 36/29, 28, 3 R, 3 B, 36/30 R, 31, 27, 102, 103, 107, 108, 114, 92, 32 R, 25 R, 35 R, 37, 136

[56] References Cited

U.S. PATENT DOCUMENTS

| | | | |
|---|---|---|---|
| 1,498,838 | 6/1924 | Harrison, Jr. | 36/29 |
| 2,100,492 | 11/1937 | Sindler | 36/29 |
| 4,271,606 | 6/1981 | Rudy | 36/29 |
| 4,347,673 | 9/1982 | Svetlik | 36/32 R |
| 4,391,048 | 7/1983 | Lutz | 36/37 |
| 4,398,357 | 8/1983 | Batra | 36/31 |
| 4,593,482 | 6/1986 | Mayer | 36/28 |
| 4,680,875 | 7/1987 | Danieli | 36/28 |
| 4,712,314 | 12/1987 | Sigoloff | 36/136 |
| 4,733,483 | 3/1988 | Lin | 36/28 |
| 4,754,559 | 7/1988 | Cohen | 36/28 |
| 4,768,295 | 9/1988 | Ito | 36/29 |
| 4,782,603 | 11/1988 | Brown | 36/28 |
| 4,794,707 | 1/1989 | Franklin et al. | 36/31 |
| 4,815,221 | 3/1989 | Diaz | 36/28 |
| 4,817,304 | 4/1989 | Parker et al. | 36/28 |
| 4,843,741 | 7/1989 | Yung-Mao | 36/114 |
| 4,845,863 | 7/1989 | Yung-Mao | 36/114 |

FOREIGN PATENT DOCUMENTS

| | | | |
|---|---|---|---|
| 51-126733 | 10/1976 | Japan . | |
| 65780 | 10/1986 | Rep. of Korea . | |
| 89-02341[U] | 3/1990 | Spain . | |
| 119781 | 3/1990 | Spain . | |
| 483807 | 2/1970 | Switzerland | 36/29 |
| 390368 | 4/1933 | United Kingdom | 36/29 |

OTHER PUBLICATIONS

Sport Style, Oct. 5, 1987, Nike Air Walker Max.

Mondo della Calzatera Italiano, Jun. 1988, p. 57, Betaplast Shoe.

Information (Exhibits 1-6) made public during litigation cases No. 89-1904-Y and No. 337-TA-309.

*Primary Examiner*—Steven N. Meyers

*Attorney, Agent, or Firm*—Sterne, Kessler, Goldstein & Fox

[57] ABSTRACT

The present invention utilizes an upper and a midsole which is disposed in a conventional manner below the upper. The midsole includes an elastomeric material and has a number of spaced-apart horizontal tubes extending the width of the midsole which are encapsulated in the elastomeric material. The tubes are hollow and lay side by side in a direction either perpendicular to the longitudinal axis of the shoe, parallel to the axis, or in any other direction functional for foot and shoe mechanics. The elastomeric material has a hardness less than the tubes and fills the space between the tubes. To visualize the midsole, a transparent window may be utilized.

4 Claims, 8 Drawing Sheets

TUBULAR CUSHIONING SYSTEM FOR SHOES

This application is a continuation of application Ser. No. 304,615, filed 2/1/89 now abandoned which is a continuation-in-part of application Ser. No. 070,214, filed 7/6/87 also now abandoned.

BACKGROUND OF THE INVENTION

1. Field of the Invention

This invention relates generally to athletic shoes, and more particularly to systems for cushioning the midsoles of athletic shoes.

2. Description of Related Art

In recent years, there have been a number of attempts to incorporate additional cushioning into the midsole of an athletic shoe. The midsole of a shoe is the portion of the shoe which lies between the outsole and the inner sole and it is the development of the midsole which has led to shoes which take into account human foot physiology. It is the midsole of the shoe, usually made of a polyurethane or ethylene vinyl acetate (EVA) material, which is primarily designed to manage pronation problems and to absorb shock.

One category of developments which attempt to cushion the foot of a user is those which incorporate a pneumatic device within the midsole. This concept is shown in U.S. Pat. No. 545,705, issued to MacDonald. In this patent, an elastic air-filled cushioning device is incorporated into the heel of a shoe to provide cushioning. A similar device is taught in U.S. Pat. No. 1,498,838 issued to Harrison, Jr., which utilizes a number of tubes which lie within the midsole of a shoe. These tubes are inflated by a valve to maintain a pressure above ambient pressure. The tubes in Harrison, Jr., are made of a flexible material which is inelastic. Another patent in this same category is U.S. Pat. No. 4,219,945, issued to Rudy, which discloses a pneumatically inflated insert which is encapsulated in a foam midsole. In the shoe taught by this patent, the insert is filled with a mixture of large-molecule gases which attempts to prevent diffusion outwardly from the chambered insert.

The disadvantages of encapsulating gas within the midsole of a shoe are numerous. It is exceedingly difficult and costly to encapsulate gas in a material which also has desirable mechanical properties. It is much easier, for example, to cut a piece of EVA to desired specifications than to make a container which retains pressurized air or other gas. Many easily molded plastics will allow encapsulated air to diffuse out of its container. Therefore, large molecule gases must be used as the encapsulated gas thereby increasing the expense of manufacturing such a shoe. Material puncture is also a problem with pressurized gas midsoles.

Another serious drawback with shoes utilizing a pressurized encapsulated midsole is that the pressure of the gas within the escapsulating container is temperature dependent. As a shoe warms up, it has a different stiffness. Similarly, the shoe may respond differently in warm or cold temperature. The response of these types of midsoles may also be altitude dependent.

Yet another serious drawback in the encapsulated gas midsoles of the prior art is that these shoes do not have adequate rearfoot control and stability. In simple terms, encapsulated gas midsoles are often times too mushy to give proper support.

In addition to the three patents discussed above, there are a number of other patents which attempt to cushion the midsole of a shoe by using a pneumatic insert. Many of these devices have the same disadvantages, e.g., requiring that the tubes maintain their inflated pressure, diffusion through the tubes, and manufacturing difficulties.

Another category of development which attempts to provide extra cushioning to the midsole of a shoe is disclosed in U.S. Pat. No. 4,322,892 issued to Inohara, which teaches a shoe having a wedge portion which forms the heel of the shoe. This wedge portion has incorporated therein a number of hexagon-shaped apertures which traverse the width of the shoe. This patent also discloses the possibility of using circular cylinders rather than hexagonal apertures. Because the apertures are merely voids formed directly in the midsole, the shoe taught by this patent does not achieve rebound and cushioning to the extent possible. U.S. Pat. No. 4,235,026, issued to Plagenhoef, shows a midsole of a shoe which utilizes triangular openings. These openings extend from the lateral side of a shoe but do not extend completely through the shoe. This allows greater cushioning at the portion of the foot which first impacts the ground and less cushioning at the medial side of the shoe. This shoe seeks to account for the fact that the lateral side of a shoe strikes the ground first and the foot rolls in the direction of the medial side of the shoe. U.S. Pat. No. 4,445,284, issued to Sakutori, shows a shoe which has bores which traverse the shoe in a direction perpendicular to the longitudinal axis of the shoe. These bores have at each end thereof a check valve which allows air to flow into the longitudinal bores but not out of the longitudinal bores. Also communicating with each bore is a narrow slot which enables air to flow out of the bore upon compression of the bore. Another patent which uses air at ambient pressure within circular bores is U.S. Pat. No. 4,593,482, issued to Mayer, which shows a sandal having a plurality of interconnecting modular elements. These modular elements form the sole of a shoe and are closely packed. U.S. Pat. No. 4,656,760, issued to Tonkel et al., is a cellular insert for a midsole of a shoe. While in one embodiment of this invention the cells formed by a polymeric woven material form hollow cells, these cells are formed from a single strand of material and therefore cannot act independently of each.

U.S. Pat. No. 4,430,810, issued to Bente, discloses a shoe which utilizes at least one replaceable insert in the sole of a shoe. The tubes in this shoe are made to frictionally engage a bore in the midsole of the shoe, thereby causing localized pressure differentials and gradients in the surrounding material. The Bente patent is directed to a device for controlling the stiffness of a shoe and is therefore able to use solid rod inserts.

U.S. Pat. No. 4,536,974, issued to Cohen, is a shoe with a deflective and compressible midsole. This shoe utilizes a plurality of ribs which, when a force is applied to the midsole, deflect and come into contact thereby restricting further deflection. There are two separate and distinct compression stages in the Cohen midsole. Initially, the ribs in Cohen do not easily deflect. As the midsole compresses, it becomes increasingly less difficult to compress the midsole. Therefore, in the first stage of compression there is a negative pressure gradient, that is, the greater the deflection, the less force needed to deflect. In the second compression stage of Cohen, the ribs come into contact with each other. When the ribs are in contact, the only way for the midsole to compress is for the ribs to compress. Therefore, in the second stage of compression there is a positive pressure gradient; the more the midsole is compressed the greater force is needed to compress. In the Cohen device there may also be secondary buckling of the ribs because the forces are not angled along the rib.

It is clear from the developments discussed above that there are many disadvantages in the art related to the present invention. The disadvantages of encapsulated gas soles include high construction costs, lack of stability, puncture problems, temperature dependence, and diffusion of gas out of the gas container. For other soles having various apertures, the disadvantages include abrupt changes in the pressure needed to deflect the midsole. Other shoes simply have not recognized the need to provide a sole having good rebound as well as cushioning.

One of the trends in athletic footwear is to present the technology of the footwear in such a fashion as to enable the purchaser to visualize the technology. Unfortunately, it can be difficult to display the technology without adversely affecting the performance of the shoe. For example, some shoes have provided "windows" for viewing the interior of midsoles. Such windows, placed on the edge of the midsole, may effect the cushioning characteristics of the midsole. If such is the case, displaying the technology may outweigh whatever benefits may be derived from the technology itself.

One of the objects of the invention is to provide a way of viewing the invention in a useful and unobtrusive way.

SUMMARY OF THE INVENTION

In accordance with the purposes of the present invention as embodied and broadly described herein, the athletic shoe of the present invention utilizes an upper and a midsole which is disposed in a conventional manner below the upper. The midsole includes an elastomeric material and has a number of spaced-apart horizontal tubes extending the width of the midsole which are encapsulated in the elastomeric material. The tubes are hollow and lay side by side in a direction either perpendicular to the longitudinal axis of the shoe, parallel to the axis, or in any other direction functional for foot and shoe mechanics. The elastomeric material has a hardness less than the tubes and fills the space between the tubes. The tubes preferably have a Shore D Durometer hardness of between 55 and 72 and are spaced at a distance which causes the material between the tubes to compress when a force is applied perpendicular to the midsole. The material between the tubes is compressed because of the deformation of the tubes and causes the tubes to resist further compression.

In another aspect of the invention, the elastomeric material used to form the midsole preferably has an Asker C Durometer hardness of between 35 and 65. The elastomeric material may be made of either polyurethane (PU) or ethylene vinyl acetate (EVA).

In yet another aspect of the invention, the tubes may be placed in either the heel portion of the midsole or in the forefoot portion of the midsole or both. The tubes used in the athletic shoe preferably have a circular cross-section and have an outside diameter of between 4 and 18 millimeters and have a wall thickness of between 0.4 and 1.0 millimeters. The spacing between adjacent tubes is preferably between 0.5 and 9.0 millimeters.

In yet a further aspect of the invention, the tubes used within the midsole are preferably made of Hytrel (TM), manufactured by E. I. DuPont de Nemours and Company, Inc.

In yet another aspect of the invention, the tubes, when placed in the forefoot part of the midsole, are preferably disposed at a 13° angle from perpendicular to the longitudinal axis of the shoe and are substantially parallel to a line formed by the metatarsals of the foot.

One advantage of the invention is that maximum rebound effect can be obtained by using a particular spacing of tubes in a midsole. Another advantage of the invention is that the midsole of the present invention is easily manufactured and utilizes easily available materials.

Another advantage of the invention is realized when using Hytrel, which has good rebound characteristics, is lightweight, and provides superior cushioning effects. Hytrel is also a sturdy material and is easily bonded to the surrounding elastomeric midsole.

In yet another aspect of the invention, an athletic shoe is provided which includes an outsole which defines a cutout. The athletic shoe has a midsole which includes a body portion and an insert portion, the insert portion including tubes for providing energy return and being visible through the cutout in the outsole.

In yet another aspect of the invention, the tubes are seated in seating grooves which are formed from the body portion of the midsole.

In yet another aspect of the invention, a transparent polyurethane forms a window for enabling visualization of the tubes in the midsole.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawing.

DETAILED DESCRIPTION OF THE PREFERRED EMBODIMENTS

Figure 1:
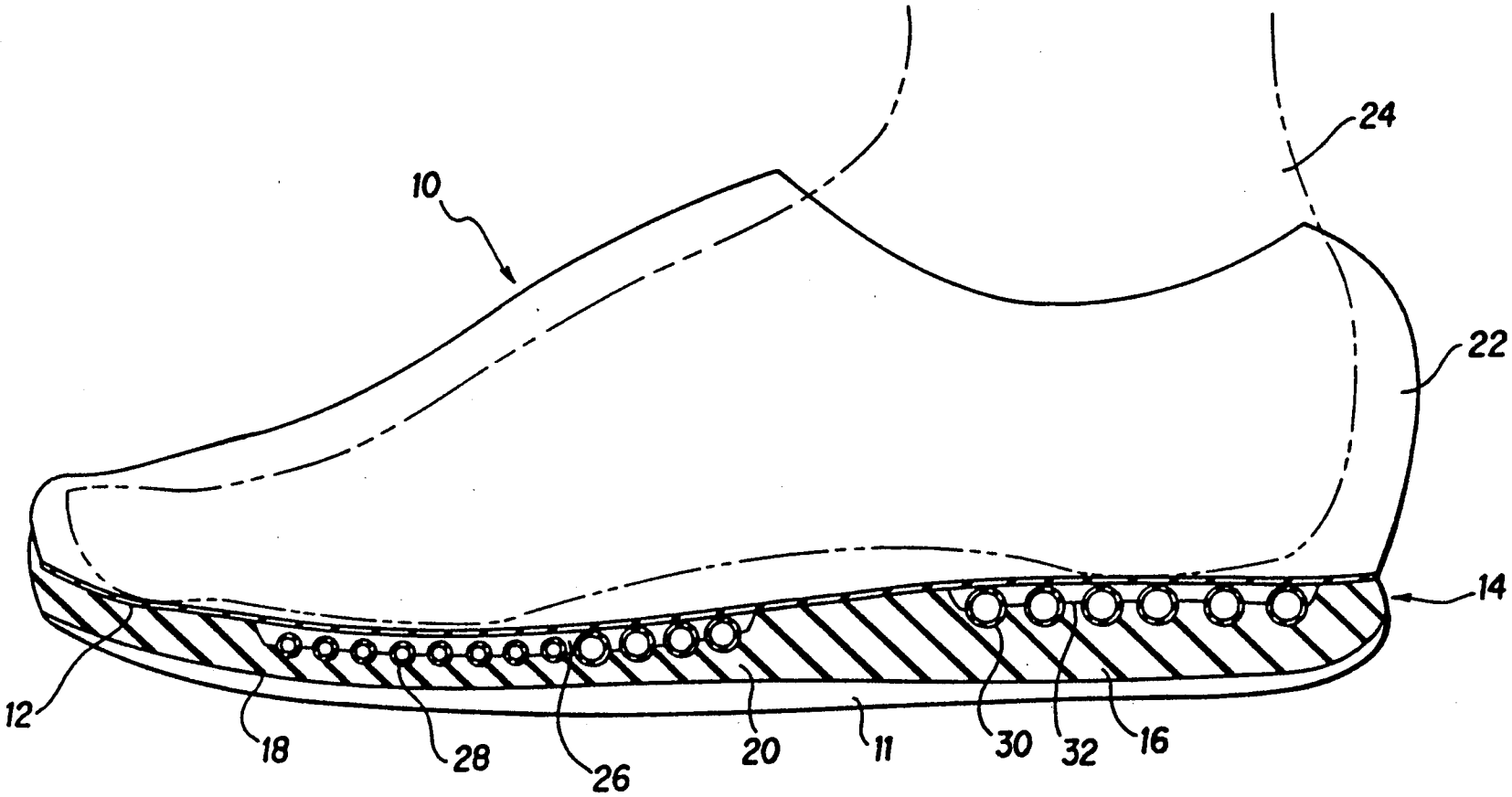
FIG. 1 is a longitudinal, sectional side view of an athletic shoe midsole incorporating a preferred embodiment of the present invention.

Referring to the accompanying drawings, FIG. 1 is a side elevation view of an athletic shoe incorporating the shock absorbing midsole of the present invention. The shoe, designated generally as 10, has an inner sole 12 which is positioned above the midsole 14. The inner sole is attached to the other components of the shoe in any conventional manner such as by gluing or stitching. As with most shoes, an outsole 11 is attached to midsole 14 as shown in FIG. 1.

The midsole 14 of the present invention has a heel portion 16, a forefoot portion 18, and a midfoot or arch portion 20. There are not specific boundaries which define these three sections of the midsole, however it should be generally understood that these three portions of the midsole, together, extend the entire length of the midsole. A conventional upper 22 may be attached to the midsole in any conventional manner. In the preferred embodiment of the invention, the upper is cemented to the midsole in any of a number of well known ways.

One purpose of the invention is to give cushioning to a foot 24, shown in dashed lines, and to provide a rebounding effect when the foot is not applying pressure to the midsole.

Figure 5:
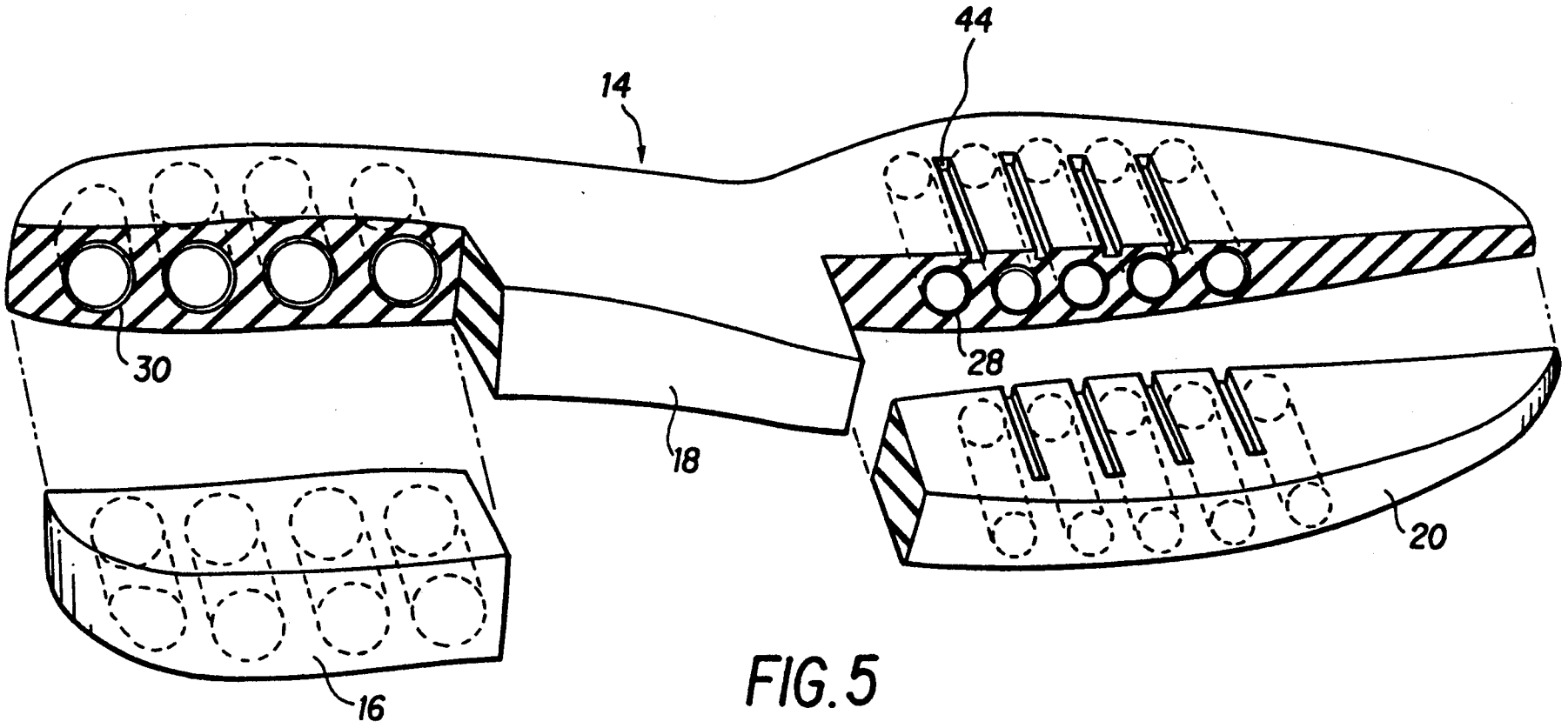
FIG. 5 is a perspective, partially cutaway, exploded view showing one possible construction of the invention.
Figure 6:
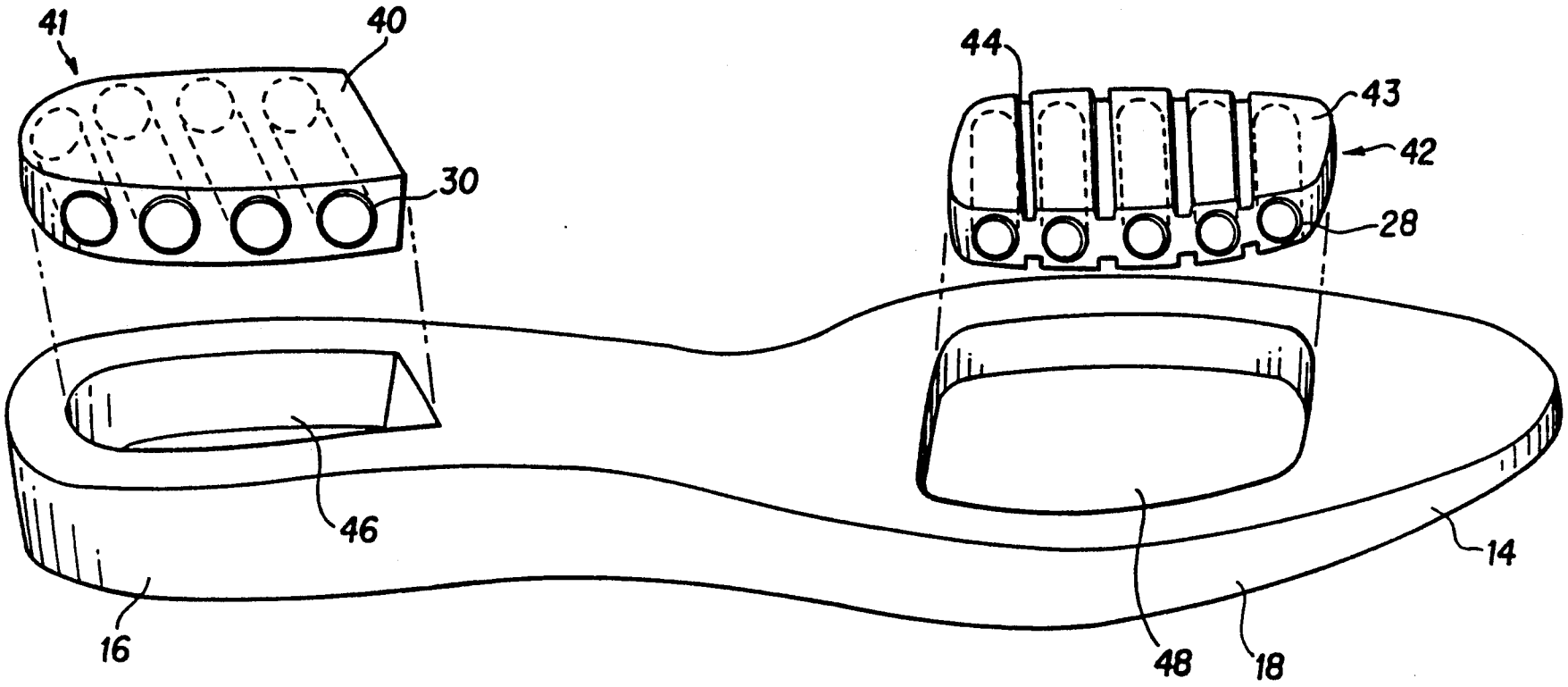
FIG. 6 is a perspective, exploded view of another possible construction of the present invention.

In one embodiment of the invention, sections 26 and 32 are cut from the upper surface 15 of midsole 14 in the forefoot and heel and have semi-circular seats which provide a stable physical structure for seating forefoot tubes 28 or heel tubes 30 or both. The tubes may either be seated as shown in FIG. 1 or completely encapsulated as shown in FIGS. 5 and 6. In the embodiment shown in the figures, the tubes have a circular cross section. By using tubes having this geometry, the tubes take up a maximum volume with the least amount of material. Because weight is an important parameter when designing a shoe, this allows the shoe to have a minimum weight.

The midsole material may be made of any conventional elastomeric material. In the preferred embodiment of the invention either polyurethane or EVA is used to form the midsole. The tubes 28 and 30 are formed from a material having a hardness of between 55–72 Shore D Durometer. An ideal material for the tubes is Hytrel (TM), manufactured by E. I. DuPont de Nemours and Company, Inc. Hytrel is semi-crystalline and a full polymerized, high molecular weight, chemically stable, thermoplastic polyester elastomer composed of alternate amorphous and crystalline chains. This material is ideal for utilization in the tubes of the present invention because it has exceptional memory characteristics. In other words, Hytrel tubes tend to return to their original shape after being deformed. This enables the Hytrel tubes to be used for both cushioning and rebound in the present invention. In operation, energy is stored when the tubes are compressed and returns in the form of rebound energy when the user is lifted. The Hytrel also has good strength characteristics and can withstand many compression cycles.

Figure 2B:
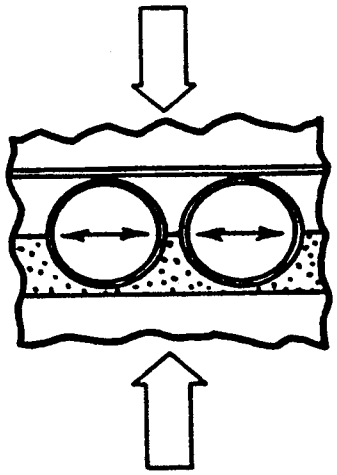
FIG. 2*b* is a schematic showing adjacent tubes of the present invention with a force applied.
Figure 2A:
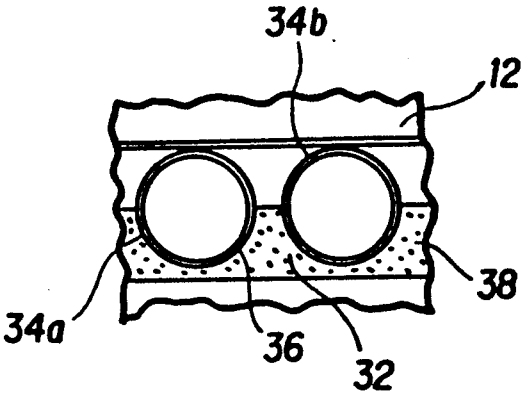
FIG. 2*a* is a schematic showing adjacent tubes of the present invention without force being applied.

Referring now to FIG. 2, two schematics are shown which help to describe the interaction of tubes in the present invention. FIG. 2*a* shows a schematic of the tubes 34*a* and 34*b* in an unstressed state. The tubes shown in this figure are seated in the semi-circular seats 36 which are formed in an elastomeric material 38. On top of the tubes rests inner sole 12. It can however be appreciated that the tubes may be completely encapsulated by the polyurethane material and in fact in a preferred embodiment of the invention the tubes are completely encapsulated, including encapsulation of the ends of the tubes. By encapsulating the ends of the tubes, the ends do not easily collapse as with open ended tubes. If a polyurethane or other elastomeric material is used to completely encapsulated the tubes 34 the inner sole 12 may be attached directly to the elastomeric material. In such a case there may be a space between the tubes 34*a* and 34*b* and the inner sole 12 which is filled with the elastomeric material.

FIG. 2*b* of the accompanying drawings is a schematic of the tubes of the present invention under compression. The large arrows represent the force of a foot pressing on the midsole and the corresponding pressure from the ground. When these forces are placed in the midsole the tubes are compressed and are therefore no longer circular in cross-section. Because the tubes have a major axis which is parallel to the ground, the material between the tube is compressed. In other words, the smallest distance between the tubes is decreased thereby causing the elastomeric material between the tubes to compress. This compression in turn helps to resist further compression of the midsole. In short, the more the midsole is compressed the more difficult it is to compress the midsole further. One aspect of the invention is that the tubes 34*a* and 34*b* never come into contact with each other. This avoids abrupt changes in the cushioning effect and creates a constant pressure gradient through the thickness of the midsole.

After the forces shown in FIG. 2*b* are removed, the midsole returns to the configuration shown in FIG. 2*a*. The Hytrel used to practice the invention has good memory characteristics and therefore readily returns to the original configuration. Because the material between the tubes 32 has been compressed, a force is generated in the compressed material to help the tubes return to their original shape. Also, the pressure created by adjacent tube members generates a quicker response in returning the tubes to their original shape.

Because the invention seeks to form a midsole which has superior cushioning and rebound characteristics, the spacing of the tubes as well as the material used to make the tubes and the encapsulating midsole must be carefully chosen. The outside diameter of the tubes should be between 4 millimeters and 18 millimeters and must preferably allow for at least one millimeter of polyurethane encapsulation at the bottom of the tubes. If the entire tube is encapsulated there should be at least one millimeter of encapsulation at the top and bottom of the tubes. The wall thickness of the tubes should be between 0.4 millimeter and 1.0 millimeters and the spacing between the tubes should be between 0.5 millimeter and 9.0 millimeters. It is however anticipated that the wall thickness of the tubes may be up to 2.0 millimeters or more under some circumstances. The above spacing is measured at the closest point between tubes and is measured in an unstressed configuration. In other words, when a tube having a circular cross-section is used the closest distance between the tubes shown in FIG. 2*a* should be between 0.5 millimeter and 9.0 millimeters. The distance between the tubes is chosen as a function of the desired amount of tube collapse desired before the effects of the compression between the tubes has a significant effect. Because there is material between tubes 34*a* and 34*b*, the tubes are never in contact with each other. The tubes are harder than the surrounding material and preferably have a Shore D Durometer hardness of between 55 and 72. The surrounding elastomeric material may have a Asker C Durometer hardness of between 35 and 65 in the preferred embodiment of the invention.

In one embodiment of the invention, the wall thickness of the tubes need not be a constant. For example, in cross section, a tube may have an outside wall which is circular and an inside wall which is, for example, oval. Also, the thickness of the tubes may vary along the width of the shoe. For example, to help with pronation, the wall thickness of the tubes could be greater on the medial side of the shoe than on the lateral side. The thickness could vary in a smooth transition if desired or there could be one or a series of step changes in wall thickness.

Figure 3:
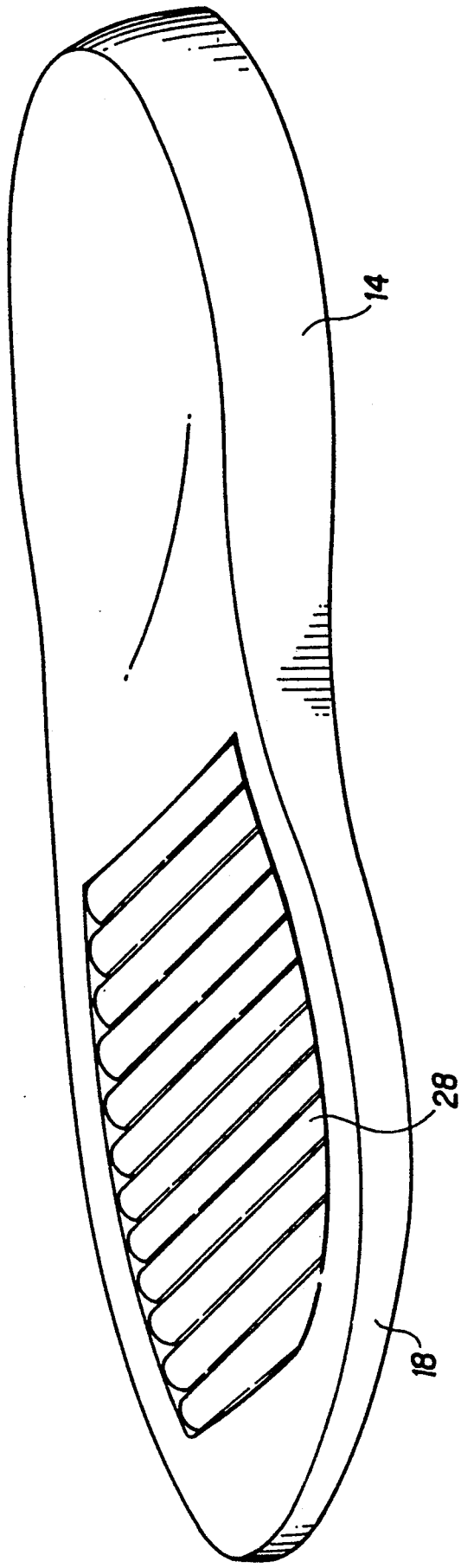
FIG. 3 is a perspective view of one embodiment of the invention utilizing tubes in the forefoot of a shoe.

FIG. 3 shows one embodiment of the invention in which tubes 28 are placed in the forefoot portion 18 of a midsole 14. In this embodiment of the invention the tubes are placed in the forefoot portion 18 only and a solid polyurethane, EVA, or other elastomeric material is used to form the heel portion of the shoe. In this embodiment any conventional method may be used to form the heel while the present invention is used in the forefoot section.

Figure 4:
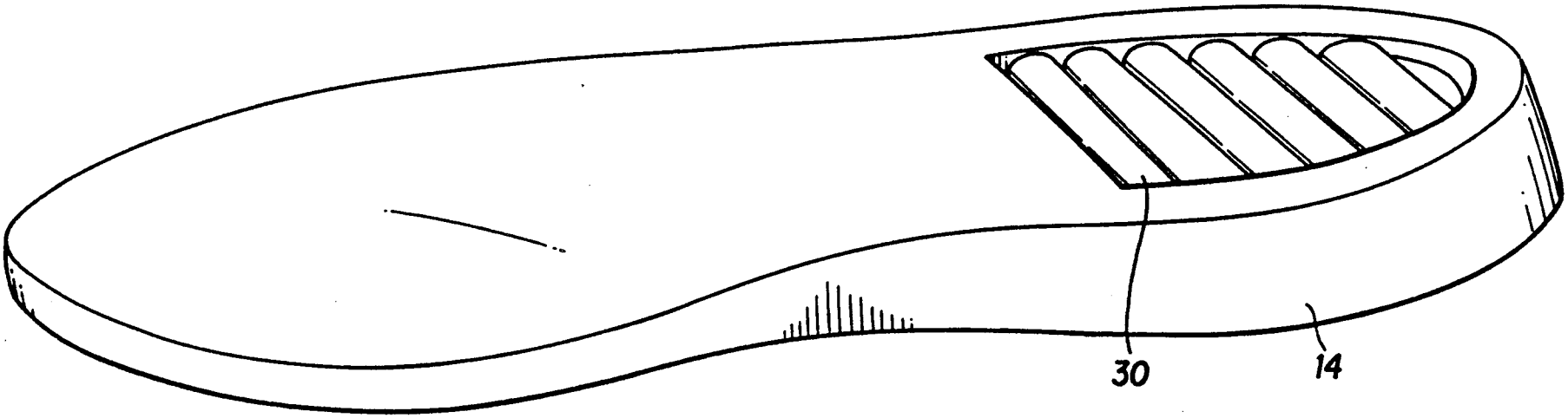
FIG. 4 is a perspective view of an embodiment of the present invention utilizing tubes in the heel portion of a midsole.

Similarly, FIG. 4 shows an embodiment of the invention wherein tubes 30 are placed only in the heel portion of midsole 14. In this embodiment of the invention a conventional forefoot section is used in combination with the invention.

FIGS. 5 and 6 show two possible methods of making the invention. The tubes of Hytrel and the polyurethane can be molded into the shape of a midsole as shown in FIG. 5 or a die cutout may be formed into pieces and incorporated into another midsole component. It should be noted that the cutaway views of FIG. 5 are for illustration only. In actuality, the midsole is a single unitary piece which has had Hytrel or other hollow tubes encapsulated thereby. In the embodiment of the invention shown in FIG. 6, heel tubes 30 are encapsulated into a heel die cutout material formed of either polyurethane or ethylene vinyl acetate (EVA). The entire die cutout section 42 which includes the tubes 30 and the heel die cut material 40 is incorporated into heel 16 of the midsole 14. The die cutout section 41 is placed within cutout 46 and attached in any conventional manner. For example the die cutout section 41 may be glued in place using any conventional bonding material. The heel die cut material 40 may be a different material than the material used to form the main part of the midsole 14. For example, the heel die cutout material 40 may be formed of polyurethane while the remaining portion of midsole 14 may be formed with a material such as ethylene vinyl acetate.

Similarly, the forefoot portion of the midsole 18 may be formed by using a forefoot die cutout section which includes a forefoot die cutout material 43 and forefoot tubes 28. As with the heel section of the shoe, the die cutout section of the forefoot 42 may be inserted into opening 48 in the forefoot of the midsole. This is done in the same manner as with the heel as described above. Grooves 44 may be included in the forefoot section for the purposes of flexibility.

Although the forefoot tubes 28 in FIG. 6 are shown to extend perpendicular to the longitudinal axis of the midsole, in the preferred embodiment of the invention the forefoot tubes 28 are angled to run parallel with the metatarsal portion of the foot. Typically the tubes are angled approximately 13° from perpendicular to the longitudinal axis of the midsole such that the tubes are furthest away from the heel on the medial side of the shoe.

FIGS. 7–11 are directed toward an apparatus for enabling a user to view technology provided within the midsole of an athletic shoe. While the embodiments of the invention shown in FIGS. 7–11 are specifically directed toward the visualization of the tube, the invention described below could be utilized with a broad range of technology.

Described previously are tubes which are disposed within the midsole of an athletic shoe. These tubes provide both cushioning and energy return without adversely affecting the overall stability characteristics of the shoe. In making the tubes visible to a user, there are a number of considerations which must be considered. Most notably, it may be necessary to select from a family of transparent materials, such materials having characteristics (such as weight, rebound characteristics) which may affect the overall performance of the athletic shoe. These problems have been solved by positioning the components of the shoe which make the midsole visible in a location which is not believed to adversely affect the overall performance of the shoe.

Figure 7:
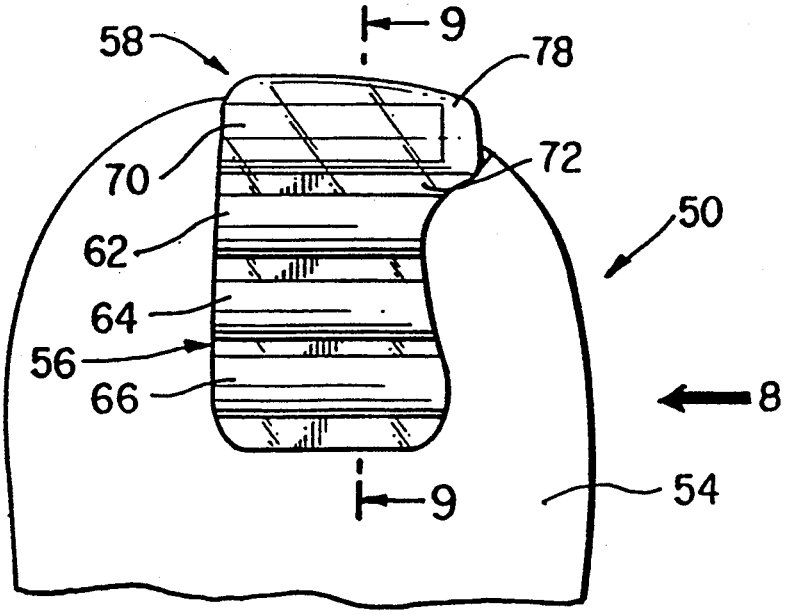
FIG. 7 is a view of the bottom of a shoe utilizing one embodiment of the invention.
Figure 8:
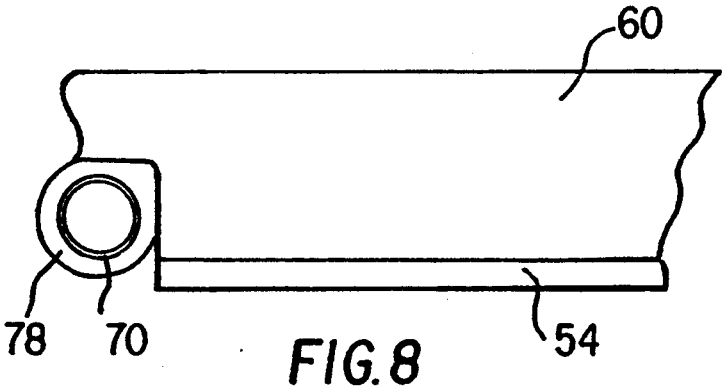
FIG. 8 is a side view of FIG. 7 the direction of arrow 8.

FIG. 7 depicts the bottom of an athletic shoe which shows one embodiment of the invention. In this figure, a visible tubular cushioning system 50 is depicted which includes an outsole 54 and a midsole 52 (see FIG. 9). The outsole 54 is made of any conventional abrasive resistant material and may include treads or any other means for providing traction.

The outsole 54 extends substantially the along entire lowermost surface of the athletic shoe. However, the outsole 54 defines a cutout 56 of suitable size for enabling visualization of the midsole or midsole components. The cutout 56 is typically positioned in a location where outsole material is not necessary. In the embodiment of the invention shown in FIGS. 7 and 11, the cutout 56 is in the heel of the athletic shoe.

Figure 10:
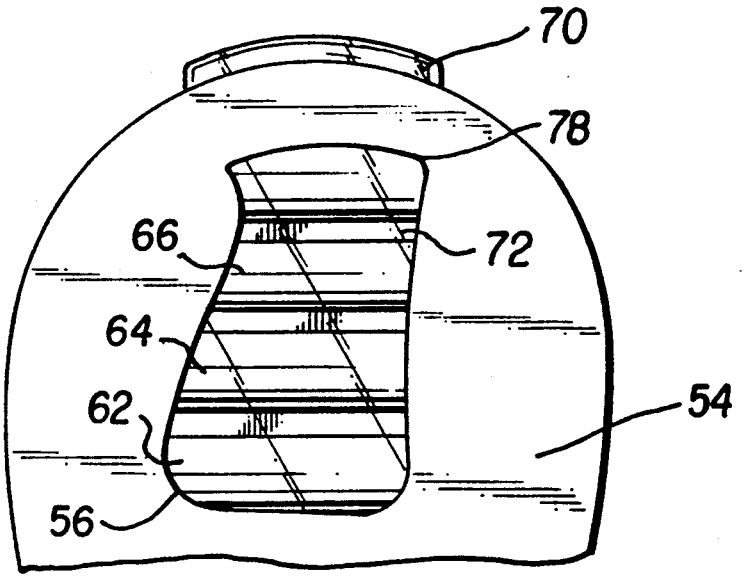
FIG. 10 is a bottom of a shoe showing an alternate embodiment of the invention.

The cutout 56 may extend to and may form an opening 58 in the rearmost portion of the heel as shown in FIG. 7. Alternatively, the cutout 56 may be completely surrounded by outsole material as depicted in FIG. 10 or may extend toward either the medial or lateral sides of the outsole 54 (not shown).

In the embodiment of the invention depicted in FIGS. 7–11, the midsole 52 includes a body portion 60 which is made of an elastomeric material. This material may be any material which is used in conventional midsoles such as polyurethane or ethyl vinyl acetate. Naturally, other materials or combination of materials may be used to form body portion 60.

Figure 11:
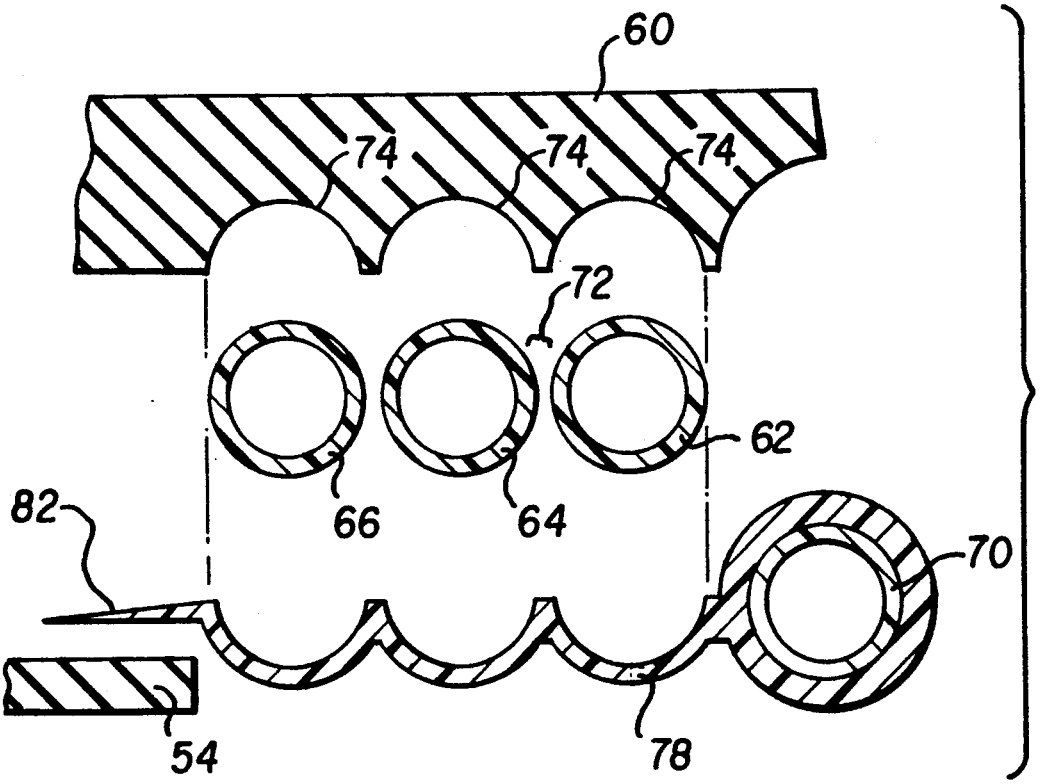
FIG. 11 is an exploded cross-sectional view of one embodiment of the invention.

As shown in FIG. 11, seating grooves 74 are formed in body portion 60. Tubes 62, 64, and 66 are secured within the seating grooves 74. The tubes 62, 64, and 66 may be secured within the seating grooves 74 in any conventional manner such as providing an adhesive between tubes 62, 64, and 66 and seating grooves 74. By providing seating grooves 74, the tubes are allowed to compress since the material forming the seating grooves is generally a conventional midsole material. As previously described, when forces are placed on the midsole the tubes compress so that they are no longer circular in cross-section. It should be noted that each tube is separated from an adjacent tube. This enables each tube to act substantially independently except insofar as herein described. As a tube compresses, it causes the elastomeric material between it and an adjacent tube to compress and store energy. This storing of energy remains possible with the embodiments depicted in FIGS. 7–11. The seating grooves 74 are used in the embodiment of the invention shown in FIGS. 7-11 to allow the storing of energy between tubes 62, 64, and 66.

As forces are removed from midsole 52, the tubes 62, 64, and 66 return to their original shape. The compressed material between tubes returns energy to the wearer. By making tubes 62, 64, and 66 out of a material such as Hytrel, the tubes 62, 64, and 66 return quickly to their original shape. It is important that the tubes 62, 64, and 66 cycle back quickly to their relaxed, unstressed state prior to being reloaded with forces.

The spacing 72 between tubes is selected to provide optimum cushioning and rebound. Typically, this spacing will be on the order of between 0.5 and 9.0 millimeters.

A transparent window 78 is provided to cover tubes 62, 64, and 66. This transparent window 78 is made of a material such as thermal polyurethane (TPU). TPU is used because it is durable, transparent and flexible. PVC or other materials may also be used to practice the invention. The transparent window 78 is exposed through the cutout 56 in the outsole 54. Typically, the window 78 will be oriented so that it does not make contact with the ground. Contact with the ground is prevented because the window 78 does not extend below outsole 52. The transparent window 78, together and in conjunction with the body portion of the midsole, will encapsulate tubes 62, 64 and 66.

Having said this, making the window out of an abrasive-resistant material such as TPU enables the window 78 to be subjected to the unavoidable incidental contact which will undoubtedly occur due to imperfections in whatever surface the user is walking or running on. In the embodiment of the invention depicted in the accompanying figures, the window 78 is spaced apart from the plane formed by the lowermost surface of the outsole at a distance of approximately 1-2 millimeters. This distance need not be constant and is not critical to the practice of the invention.

Figure 9:
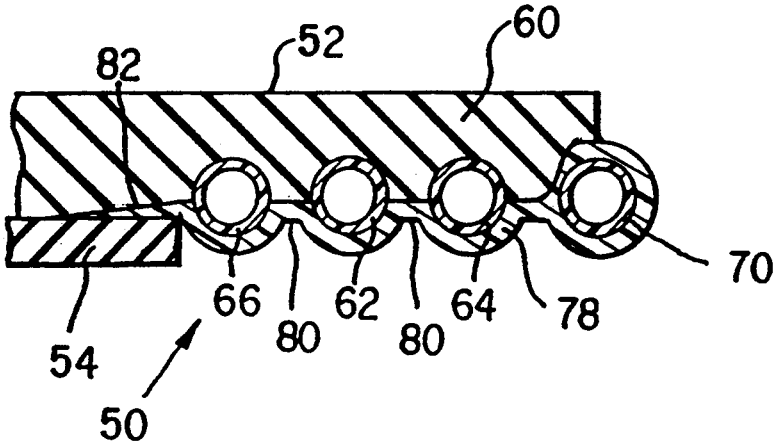
FIG. 9 is a cross-section of FIG. 7 cut along line 9—9.

Flexure grooves 80 (FIG. 9) may be provided in the window 78 to aid in the bending of the heel portion of the athletic shoe. The window 78 may follow the general curvature of the tubes as shown in FIG. 9. This increases visibility of the tubes since diffraction through the window is decreased by use of such an arrangement.

To secure the window 78 to the other components of the athletic shoe, a flange 82 (FIGS. 9 and 11) may be provided which is positioned between outsole 54 and the body portion 60 of midsole 52.

FIG. 9 illustrates an embodiment of the invention in which the rearwardmost tube 70 is completely encapsulated within the material forming window 78. This embodiment enables the rearwardmost tube to be seen from both the bottom of the shoe and the side of the shoe.

FIG. 10 is an embodiment of the invention in which window 78 is completely bordered by outsole material. Even with the window being completely bordered by outside material, the tubes may nevertheless be visible through the back or side of the shoe by providing an opening in the body portion of the midsole. Other possible embodiments would include cutouts and transparent windows of different sizes and shapes, a plurality of cutouts and transparent windows, and cutouts and transparent windows which are located in an area other than the heel.

In addition, such variables as the thickness and size of the window may be varied to provide less weight, if desired.

FIG. 11 is an exploded view of the embodiment of the invention shown in FIG. 9. In this figure, it can be seen that the seating grooves 74 are commensurate in size to the tubes 62, 64, and 66.

The foregoing description of the preferred embodiment of the invention has been presented for purposes of illustration and description. It is not intended to be exhaustive or to limit the invention to the precise form disclosed, and obviously many modifications and variations are possible in light of the above teachings. The embodiments were chosen and described in order to best explain the principles of the invention and its practical applications to thereby enable others skilled in the art to best utilize the invention in various embodiments and with various modifications as are suited to the particular use contemplated. For example it is possible that the tubes used to practice the invention may have a noncircular cross-section. It is possible for instance to have a cross-section which acts in a similar manner as the circular cross section described above. Although the drawings show tubes which are disposed perpendicular to the longitudinal axis of the shoe, it is possible to include tubes at other orientations. It may also be possible to make the insert portion of the midsole removable. It is intended that the scope of the invention be defined by the claims appended hereto.

What is claimed is:

1. An athletic shoe having a sole, said sole comprising:
   (a) an outsole, said outsole having a cutout region;
   (b) a midsole, said midsole having a body portion, and an insert portion, wherein said insert portion of said midsole includes a plurality of substantially tubular chambers, and wherein said body portion includes seating grooves which correspond to the shape of said tubular chambers, wherein said tubular chambers are substantially positioned within said seating grooves; and
   (c) a substantially transparent window disposed within said cutout region of said outsole, said transparent window being in contact with and substantially following the curvature of said tubular chambers.

2. The athletic shoe of claim 1 wherein said insert portion comprises a plurality of individual, unconnected tubes.

3. The athletic shoe of claim 1 wherein said tubular chambers extend substantially perpendicular to the longitudinal axis of said sole.

4. The athletic shoe of claim 1 wherein at least one of said tubular chambers is disposed substantially adjacent to an edge of said sole, and wherein said window is in contact with and extends along at least one of said tubular chambers to form a portion of a side of said shoe.

* * * * *